United States Patent [19]

Seelinger

[11] 4,438,888

[45] Mar. 27, 1984

[54] SELF-ALIGNING WEB REEL

[75] Inventor: Hugh D. Seelinger, Tucson, Ariz.

[73] Assignee: International Business Machines Corp., Armonk, N.Y.

[21] Appl. No.: 356,879

[22] Filed: Mar. 10, 1982

[51] Int. Cl.[3] ..... B65H 19/04

[52] U.S. Cl. ..... 242/56.9; 242/68.1

[58] Field of Search ..... 242/56.2–56.5, 242/56.9, 68, 68.1, 118.41, 180, 181

[56] References Cited

U.S. PATENT DOCUMENTS

| | | | |
|---|---|---|---|
| 2,354,952 | 8/1944 | Hornbostel | 242/75 |
| 2,967,598 | 1/1961 | Altmann | 192/114 T |
| 3,222,004 | 12/1965 | Crowe | 242/72 B |
| 3,756,521 | 9/1973 | Werner | 242/200 |
| 4,026,491 | 5/1977 | Boestrum | 242/56.9 |

*Primary Examiner*—Leonard D. Christian
*Attorney, Agent, or Firm*—J. A. Pershon

[57] ABSTRACT

A plurality of flangeless reel hubs store webs of a flexible material from a slitting operation. To quickly remove the filled reels from the individual clutch members, the inner driven diameter of the hub of the reel includes elongated diamond-shaped teeth. These teeth match with slots in the individual driving clutches. The teeth are centered and driven by the shaped slots which align and positively drive the reel. Relief cutouts are provided to accommodate the compression pressure against the hub by the many layers of web material wound under high tension onto the outer circumference of the reel hub. A single shaft with slots to match the teeth in the reel can be used to align the reels, and individual vacuum columns can accommodate the tension differences between the individual webs.

22 Claims, 10 Drawing Figures

FIG. 2
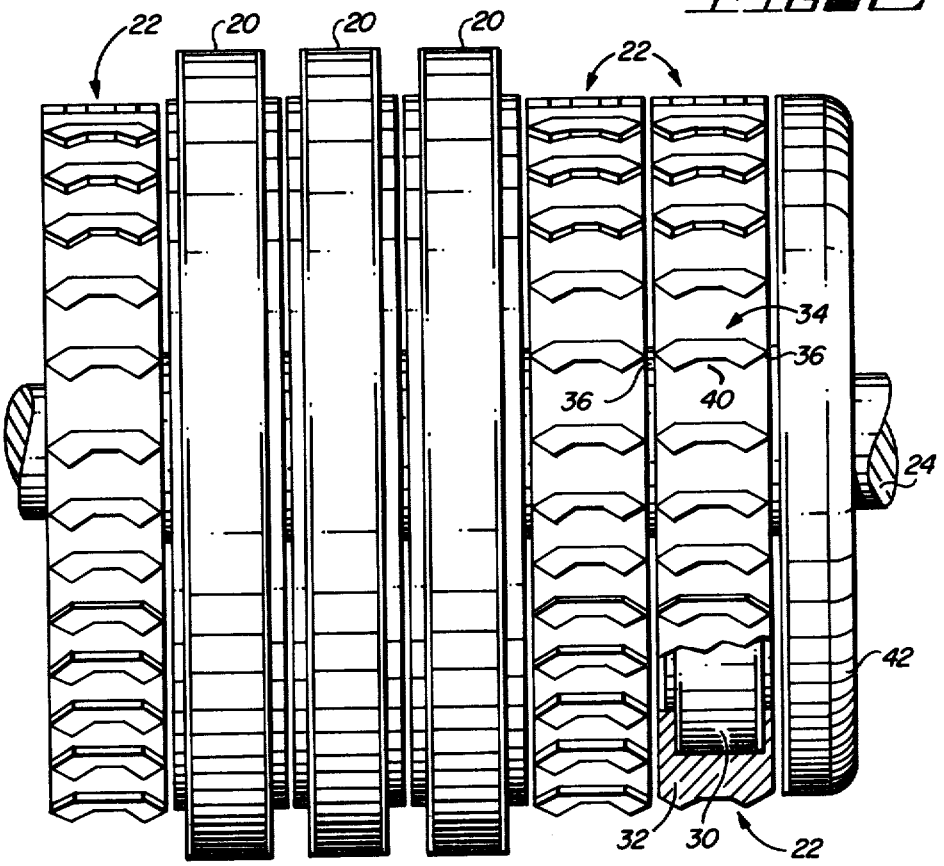
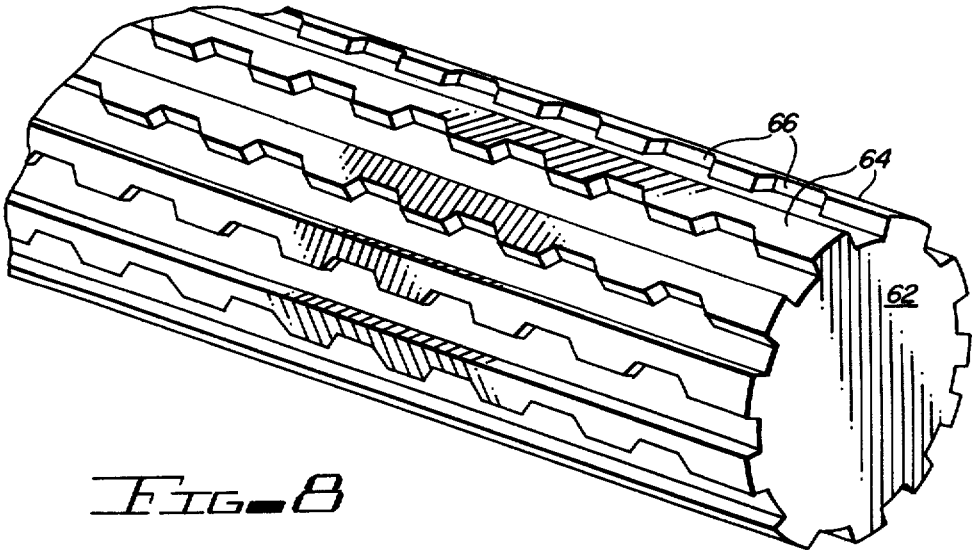
FIG. 8

SELF-ALIGNING WEB REEL

BACKGROUND OF THE INVENTION

This invention relates generally to the winding and reeling of a flexible web of material onto a holder for storage and, in particular, to an improved winding and reeling device for the concurrent winding of a plurality of reels of a web material directed from a cutting device wherein a traveling web is severed along a line parallel to the direction of travel of the fabric and wherein the reel is altered to be engaged by the driving means.

FIELD OF THE INVENTION

The winding and reeling of a plurality of webs of material onto a plurality of storage reels after the fabric is cut has been widely used. The present invention can be applied to the winding and reeling of a plurality of webs of a flexible material supplied from any source. In particular, the invention is directed to the winding and reeling of the plurality of flexible web material after a slitting operation wherein a single, wide fabric is cut into a plurality of webs. Any type of flexible web material is contemplated by this invention but, in particular, the invention is directed to the slitting and reeling of magnetic media, especially magnetic tape, which is used for the recording of information for audio, video and data processing uses.

DESCRIPTION OF THE PRIOR ART

The prior art method of reeling a plurality of webs of a flexible material after a slitting operation required that the individual reels be removed from its shaft in an unloading operation and be replaced with an empty reel for the further storage of the webs. In one apparatus, individual driving means are associated with each reel. The individual drives were necessary to accommodate for the differences in diameter of the empty reel and the differences in tension in the webs after the slitting operation. The individual drives proved costly in that separate driving means had to be accommodated for each reel, and the space required for each of the individual driving means required that the reels be offset from each other. The offsetting of the driving means took up valuable manufacturing floor space. Reel duplication for continuing winding and reeling onto one reel, while the other is unloaded and replaced by an empty reel, was extremely costly. For this reason, a single shaft containing a plurality of reels is generally used.

In a single shaft system, a plurality of clutch assemblies were fastened to the driving shaft with each clutch holding one reel for winding the web of material. Each clutch assembly included a flange which located the reel in order to center the reeling of the web. With this type of assembly, the unloading of filled reels meant that the clutch assembly for all of the reels placed on the front end of the shaft required removal in order to unload the last reel. Then the process had to be reversed, placing an empty reel on the last clutch, centering that reel and then placing each succeeding clutch assembly and reel onto the shaft, in turn, until the last assembly was placed on the shaft and fastened into position for the subsequent reeling operation.

The advantages of using the single shaft is that a turret-type assembly could be used wherein the plurality of empty reels are rotated into position to accept the plurality of webs from the slitting operation, for instance, while the second shaft on the turret is then unloaded to remove the filled reels and reloaded with empty reels for rotation into position when the presently positioned reels are filled. The loading and unloading of the clutch assemblies, in order to center the reels onto the clutch assemblies, required an expenditure of much operator time. This expenditure of time prompted some manufacturers to provide a turret with a removable shaft. However the sheer weight of the clutch assemblies and filled reels made this type of assembly extremely costly and unwieldy.

It is, therefore, an object of the present invention to provide an improved apparatus for winding and reeling a plurality of webs of flexible material onto a single shaft.

Another object of the present invention is to provide an improved winding and reeling apparatus which accepts a plurality of webs from a slitting operation.

Yet another object of the present invention is to provide a winding and reeling apparatus for reeling a plurality of webs while including means for easily centering the storage reels for the plurality of webs onto the driving means.

Prior art patents include U.S. Pat. No. 3,756,521, which discloses a winding device for a tape drive. Serrations on the hub of the tape drive and on the reel interface to cause the reel of tape to be pressed tighter onto the drive as the drive shaft rotates. There is no showing of a self-aligning feature of the present invention nor any apparatus wherein a plurality of webs can be received onto a plurality of reels mounted onto a single drive shaft.

Another U.S. Pat. No. 2,967,598 discloses a shifting arrangement for a transmission comprising an elongated diamond-shaped member which actuates against a similarly shaped member to cause the shift arrangement to enter into either one of two positions, depending upon the position of the shaft containing one of the elongated diamond serrations. There is no showing in this patent of a self-aligning feature of a specific reel member.

SUMMARY OF THE INVENTION

In accordance with the present invention, apparatus is provided for self-aligning a plurality of reels to a rotatable shaft drive. A spline means for the drive includes serrations spaced around its periphery, with the serrations having spear points at each edge of the cylinder and with a shaped slot or cutout in at least one side of each of the serrations. The flange-less supply reel includes an outer hub for accommodating one web of material from a plurality of webs and an inner hub interconnected to the outer hub. The inner hub includes an inner diameter slightly larger than the outer diameter of the adaptor. The inner diameter includes elongated teeth-like protrusions spaced around the inner diameter of the inner hub to enter between two of the spaced serrations of the adaptor. The protrusions are shaped to seat into the shaped cutouts of the projections. Means are provided for accomplishing a constant tension of each of the plurality of web members onto the outer hub of the reel.

In the preferred embodiment according to the present invention, the apparatus for self-aligning a plurality of reels to a rotatable drive shaft and winding webs of material onto each reel includes a plurality of cylindrical clutch members commonly rotated by the shaft drive and having serrations spaced around the outer surface of the circumference of each of the clutch members. The serrations include spear points at each edge of the circumference with each clutch member and a through-shaped cutout in at least one side of each of the serrations. The reel includes an outer hub for accommodating a web of material and an inner hub interconnected to the outer hub. The inner hub includes an inner diameter slightly larger than the outer diameter of the clutch member. The inner hub includes elongated diamond-shaped protrusions spaced around the inner diameter of the inner hub to enter between two of the spaced serrations of the clutch means. The protrusions of the reel are shaped to seat into the trough-shaped cutouts of the serrations of the clutch. The winding apparatus can be used for reeling a plurality of webs of flexible material after a slitting operation. Each reel may include an inner connection between the outer hub and the inner hub having relief offsets spaced apart with one end connected around the outer circumference of the inner hub and a second end connected to the inner circumference of the outer hub. The relief offsets accommodate the radial compression of the layers of the web of material as the layers are reeled onto the outer hub. A guide member is fastened to the free end of the shaft to assist in mounting the reels onto the clutch members. The inner diameter of the inner hub of the reel is of a size such that only the protrusions at and adjacent to the tangent position of the web of material relative to the outer hub seat into the shaped cutouts of the serration for aligning the reels with the shaft and the webs.

A further object of the present invention is to provide an improved mechanism for winding and reeling a plurality of webs from a slitting operation onto a plurality of reels individually driven through clutch members having self-aligning interconnections with the plurality of clutch members driven by a single shaft.

Still another object of the present invention is to provide a winding and reeling apparatus for accepting a plurality of webs onto a plurality of reels driven by a single shaft which includes an improved apparatus for loading and unloading the reels from the driving means.

Yet another object of the present invention is to provide an improved apparatus for concurrently winding a plurality of webs onto a plurality of reels together with a drive configuration that permits easy loading and unloading of the supply reels together with a self-aligning drive and reel hub configuration.

Another object of the present invention is to provide a reel with means for accommodating the compression pressure of the plurality of layers of the web onto the reel to permit ease of removal of the reels from the driving means.

These and other objects of the present invention will become apparent to those skilled in the art as the description proceeds.

BRIEF DESCRIPTION OF THE DRAWING

The various novel features of this invention, along with the foregoing and other objects, as well as the invention itself both as to its organization and method of operation, may be fully understood from the following description of illustrated embodiments when read in conjunction with the accompanying drawing, wherein:

FIG. 2 is a plan view of a shaft drive showing the self-aligning configuration of a plurality of clutch members and reels from the winding and reeling apparatus of FIG. 1;

FIG. 8 is a perspective view of the reeling apparatus of FIG. 7;

DESCRIPTION OF THE PREFERRED EMBODIMENT

Figure 1:
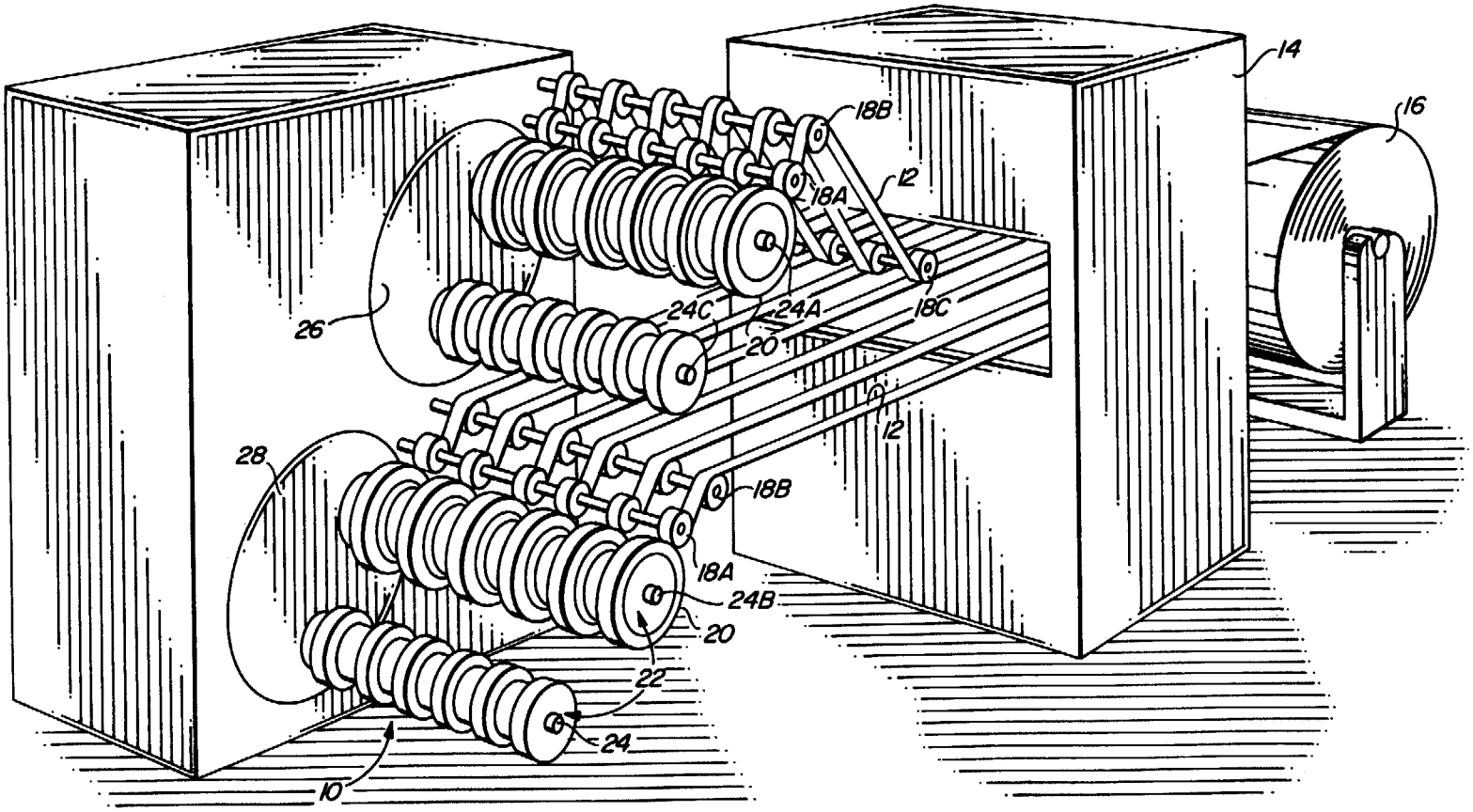
FIG. 1 is a perspective view of a winding and reeling apparatus according to the present invention.

FIG. 1 shows a winding and reeling apparatus 10 winding a plurality of webs of a flexible material, such as magnetic tape 12, from a slitting device 14. The slitting mechanism cuts a plurality of narrow widths of the magnetic tape 12, such as one-half inch or one-quarter inch widths, from a single larger width roll 16. The single larger width roll 16 of the magnetic tape has had a magnetic coating placed upon a polyethylene terephthalate substrate, for instance. The coating system coats the wide-width rolls and these wide widths of magnetic tape are then cured. After the curing operation, one wide-width roll 16 is placed into the slitting machine 14 for cutting into the widths desired. As shown in FIG. 1, the wide-width roll 16 can be cut into twelve individual webs of magnetic tape 12.

The individual webs of magnetic tape 12 is passed over an idler roller 18 and each are directed to a supply reel 20. An idler pressure roller 19 applies pressure to the tape 12 as it is being wound on the supply reel 20. Each supply reel 20 is mounted to a clutch member 22 and includes a freewheeling clutch, such as a hysteresis clutch, mounted onto a common shaft 24 as a driving means. In the reeling apparatus shown in FIG. 1, the reeling of the plurality of webs of magnetic tape are performed on two shafts 24A and 24B at one time. The shaft 24A is mounted to a turret 26 which also includes a second shaft 24C. Likewise the shafts 24 and 24B are mounted to a second turret 28. The shafts 24 and 24C, one on each of the turrets, are used for unloading the filled reels of magnetic tape and for loading the empty supply reels while the reeling apparatus is winding the tape 12 onto the reels 20 placed on the first shafts 24A and 24B, shown positioned for accepting the plurality of webs of magnetic tape. FIG. 2 shows a plan view of one of the shafts mounted to the turret while showing the relative placement of the reels onto the shaft. Only one of the shafts is shown but it is evident that all four shafts can be of similar construction.

The clutch member 22 can be a hysteresis clutch that can be purchased from many suppliers such as is shown in the Thomas Register, for instance. The hysteresis or eddy current clutch usable with this invention operates in a manner as specified in U.S. Pat. No. 2,354,952 for a paper winder operation. The hysteresis clutch, as described in the '952 patent at FIGS. 3 and 4, automatically adjusts for the greater torque effort in the drive between the driving and the driven number. As described in the '952 patent and referring to FIG. 1, the faster the driving force from the shaft 24A, for instance, and the more the supply reel 20 slips as a result of the drag by the webs of magnetic tape 12, the more driving torque is applied from the shaft to the supply reels. Thus, as a result of the hysteresis clutch, the driving effort applied to the supply reel automatically increases as the load or drag on the supply reel increases from the webs of magnetic tape.

Referring to FIG. 2, a plurality of clutch members 22 (six shown), are juxtapositioned on the shaft 24. Each clutch member 22 accommodates a supply reel 20 (three shown) for storing the magnetic tapes. Each of the clutch members 22 include a clutch 30 and a clutch adaptor 32. The clutch adaptor 32 includes projections or serrations 34 that protrude above the outer circumference of the clutch adaptor 32. Each serration 34 includes spear points 36 at each end for mating with the serrations of adjacent clutch adaptors to permit protrusions 38 of the inner diameter of the supply reels 20 (see FIG. 5) to allow the supply reels 20 to easily slip from one clutch member 22 to the next. Each serration 34 also includes an indent or cutout section 40 for mating with a particular serration of the supply reel 20 in order to hold the supply reel 20 centered onto the clutch member 22 for exact placement of each supply reel to wind the webs of tape 12 from the idler rollers 18. A guide member 42 is placed on the end of the shaft to assist in the centering of the supply reels 20. The details of the clutch members 22 including the clutch 30 and the clutch adaptor 32, and the supply reel 20 are shown in FIGS. 3–5.

Figure 3:
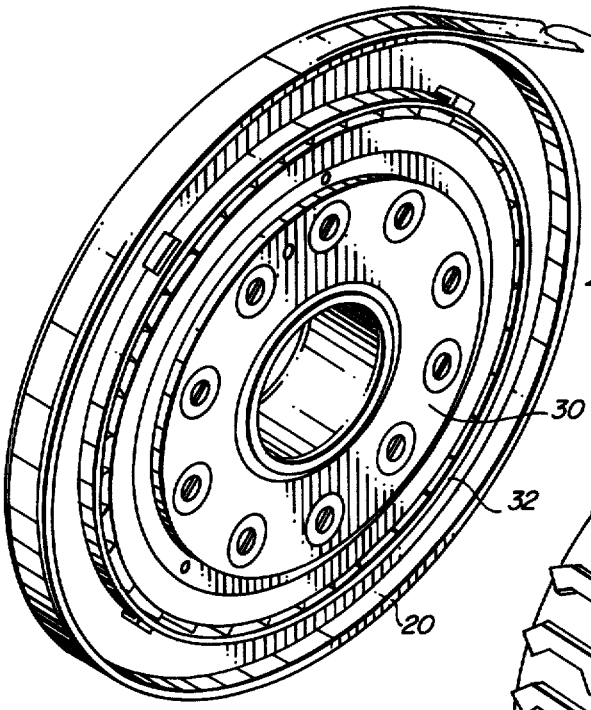
FIG. 3 is a perspective view of one clutch and clutch adaptor having a reel mounted thereon for mounting onto the reeling and unreeling apparatus as shown in FIGS. 1 and 2.
Figure 4:
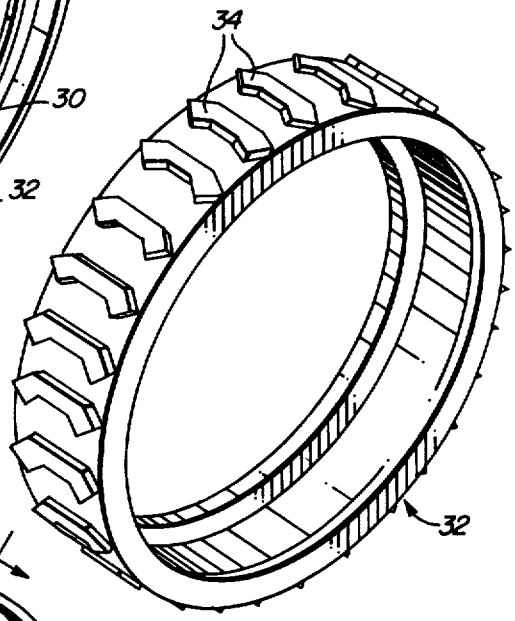
FIG. 4 is a perspective view of a clutch adaptor of FIG. 3 showing the shape of the serrations on the outer circumference of the adaptor.

Each reeling device 44 shown in FIG. 3 includes the clutch 30, the clutch adaptor 32 that attaches to the outer circumference of each clutch 30, and the flangeless supply reel 20. A length of the magnetic tape 12 is shown attached to the outer circumference of the supply reel 20. The clutch adaptor 32 itself, shown in FIG. 4, includes the serrations 34 spaced about its outer circumference. The supply reel 20, shown in FIG. 5, includes the protrusions 38 spaced around its inner diameter. These protrusions 38 couple with the serrations 34 of the clutch adaptors 32 to center and drive the supply reel 20. For the preferred embodiment, each protrusion 38 forms an elongated diamond shape to mate with one cutout 40 cut into the serration 34 of the clutch adaptor 32 (see FIGS. 2 and 4). The supply reels 20 include an outer hub 46 for accepting the tape 12 as it is wound in layers around the outer circumference of the supply reel 20. The supply reel 20 is generally used as a storage device to hold a length of the magnetic tape 12. The tape is then rereeled onto the hub of a drive reel that is designed to be placed into a tape drive for reading and writing magnetic transitions on the tape according to the procedures well known in the data processing art.

Figure 5:
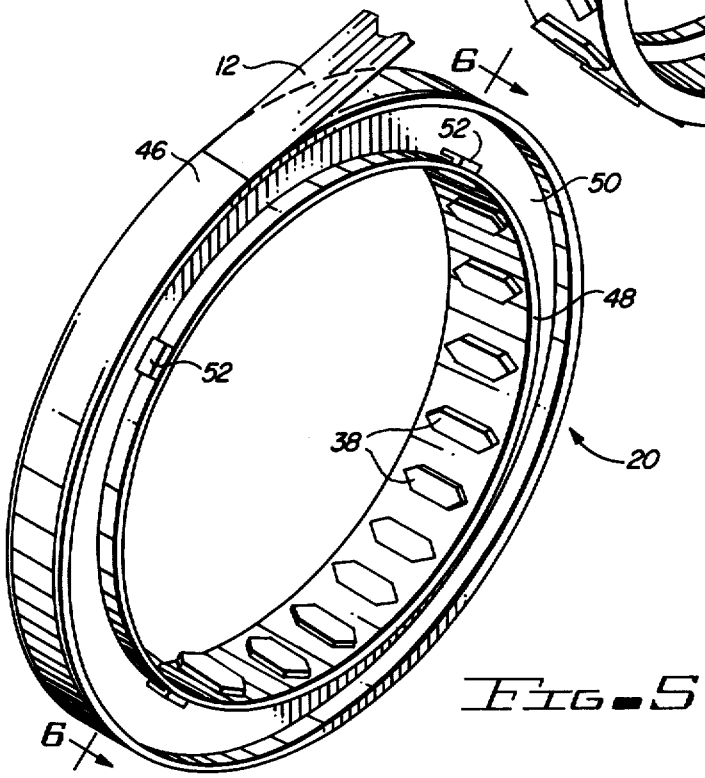
FIG. 5 is a perspective view of the reel of FIG. 3 showing the inner protrusions spaced around the inner circumference.
Figure 6:
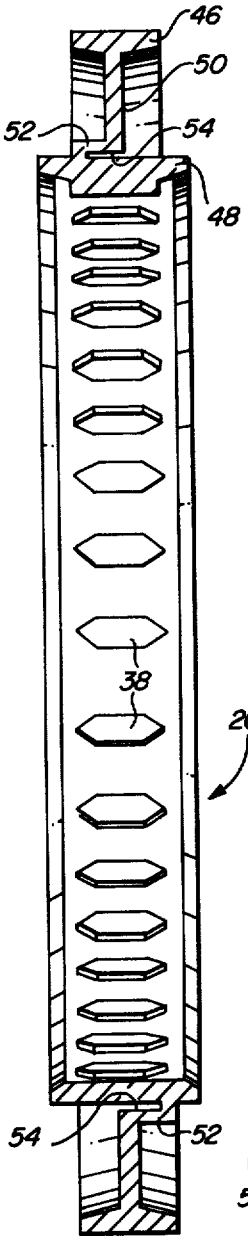
FIG. 6 is a cross-section view taken along lines 6—6 of FIG. 5.

As shown in FIGS. 5 and 6, the outer hub 46 of the supply reel 20 is interconnected to an inner hub 48 via a wall 50. The inner hub 48 has an inner diameter that is slightly larger than the outer diameter of the clutch adaptor 32. The inner diameter includes the elongated diamond-shape protrusions 38 around its inner circumference. Relief offsets 52 are spaced around the outer diameter of the inner hub 48. The relief offsets 52 project to both sides of the wall 50 and interconnect the wall 50 with the inner hub 48. The relief offsets 52 provide a space 54 between the wall 50 and the inner hub 48 to accommodate the radial compression of the layers of the tape as the layers are reeled onto the outer hub 46. The layers of tape 12 are wound onto the outer hub 46 under a relatively high tension and, without the relief offsets 52, the supply reel 20 would be difficult to remove from its clutch adaptor 32 when filled with tape.

In operation referring to FIGS. 1 and 2, empty supply reels 20 are centered onto the shaft 24 by the guide member 42 and passed over the juxtapositioned clutch members 22. The clutch adaptors 32 and the clutches 30 are firmly mounted to the shaft 24 and are generally only removed when problems with the clutch 30 and/or shaft 24 are encountered. Only the supply reels 20 are removed and replaced. As shown in FIG. 2, as the first supply reel passes over the clutch adaptor 32 at the end of the shaft, the protrusions 38 in the supply reel 20 align with the serrations 34 of the clutch adaptors 32. The first supply reel 20 placed onto the shaft 24 then aligns the second and subsequent clutch adaptors 32 to align the serrations 34 of all of the clutch adaptors. This first supply reel 20 is then positioned adjacent to the clutch adaptor 32 closest to the turret 28. The guide member 42 is mounted at the free end of the shaft 24 to assist in the centering of the supply reels 20 over the clutch members 22. The diameter of the guide member 42 is approximately equal to the diameter of the clutch adaptors 32 without the serrations 34. The supply reels 20 are passed over the guide member 42, either singly or in a group, and onto the clutch adaptors 32. As the supply reels 20 are passed over the clutch adaptors 32, the protrusions 38 on the supply reels will interact with the spear points 36 of the serrations 34 such that all of the serrations 34 will align to permit the supply reels to be passed over all of the clutch members until they are placed over their respective clutch adaptor. Thus in FIG. 2, the first supply reel will be placed onto the clutch adaptor that is closest to the turret and then all the reels will be subsequently placed over their respective clutch adaptors. As shown in FIG. 1, the shafts 24 and 24C that are positioned for unloading of both turrets 26 and 28 are loaded with empty supply reels for positioning adjacent to the plurality of tapes 12 from the slitting mechanism 14. When the supply reels 20 on the shafts 24A and 24B of turrets 26 and 28 respectively, are filled, the ends of the tape 12 are cut. The turrets 26 and 28 are rotated to position the empty supply reels placed on the shafts 24 and 24C into position for winding. The ends of the tape 12 are then fastened to the outer hubs 46 of the supply reels 20. The shafts 24 and 24C are then rotated. The tension placed onto the ends of the tape 12 from the slitter 14 keeps the supply reels 20 from rotating until the rotation of each shaft gains a certain speed such that each hysteresis clutch 30 starts to overcome the tension of the ends of the tape. Urging the clutch members 22 in the counterclockwise rotation, as shown in FIG. 1, causes the protrusions 38 on the inner hub 48 of the supply reels to seat within the cutout section 40 of the serrations 34 of the clutch adaptors 32 (see FIG. 2). In this motion, the supply reels 20 are centered over their respective clutch members 22 such that the tape can be wound in layers over the reels without the use of flanges while maintaining the integrity of the stack of layers of tape. Since each inner diameter of the inner hub 48 of the supply reel 20 is slightly larger than the diameter of the clutch adaptor 30 of the clutch member 22, the centering indent section 40 of the serrations 34 drive the protrusions 38 of the supply reels only at a position that is tangential to the contact of the tape to the supply reel 20. With this preferred size of the diameters of the clutch members and the inner diameter of the supply reel, the supply reel can be easily removed from the clutch members while at the same time the tolerance between adjacent protrusions can be loosened somewhat without affecting the centering action of the supply reels when in contact with its clutch member.

As the tape is wound onto the supply reels, the filled supply reels from the previous winding operation are removed from the shafts and clutch members 22. As before for the loading operation, in the unloading of the supply reels 20 the protrusions 38 on the inner hub 48 of the supply reels causes the serrations 34 of the clutch members 22 to align such that a group of supply reels may be removed at one time. The supply reel closest to the turret can be removed as easily as the first supply reel on the shaft. Empty supply reels can then be reloaded over the guide member 42 and over the clutch members 22 as previously stated. The clutches 30 in the preferred embodiment operate as a means for accommodating for individual differences in tension of the tape 12 as it leaves the slitters 14. Thus a shaft may be splined with centering cutouts to hold the individual reels if another method could be used to accommodate for the differences in tension from the individual reels, and the differences in the diameter of the reels.

Figure 9:
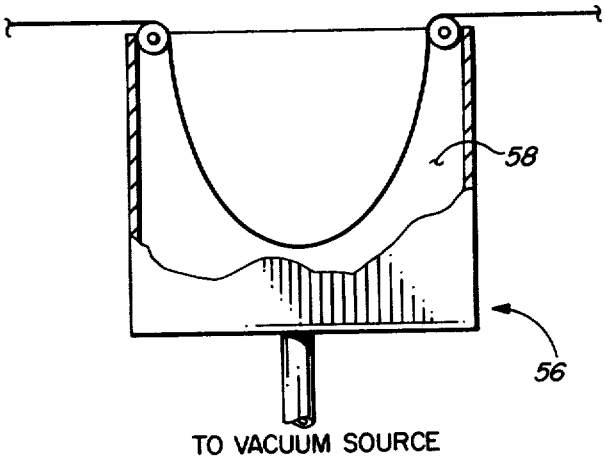
FIG. 9 is a plan view of the tension adjusting apparatus of FIG. 7.
Figure 10:
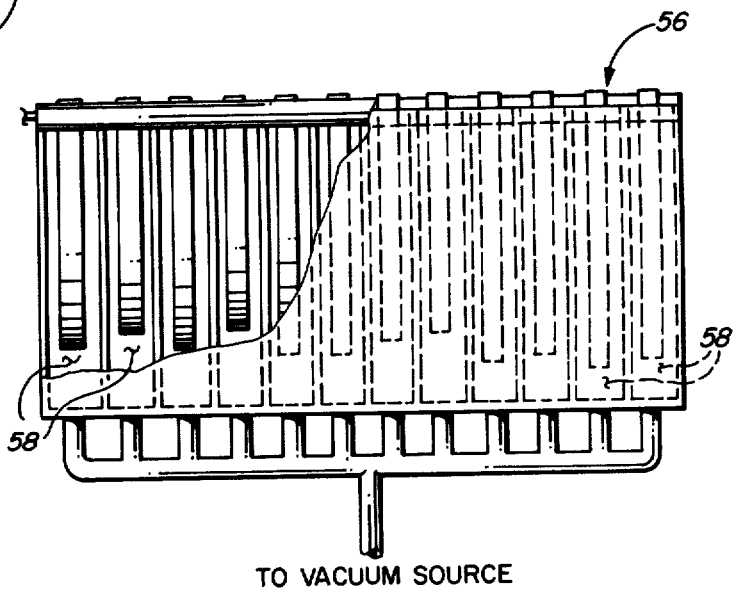
FIG. 10 is a cross-sectioned side view of the tension adjusting apparatus of FIG. 8.
Figure 7:
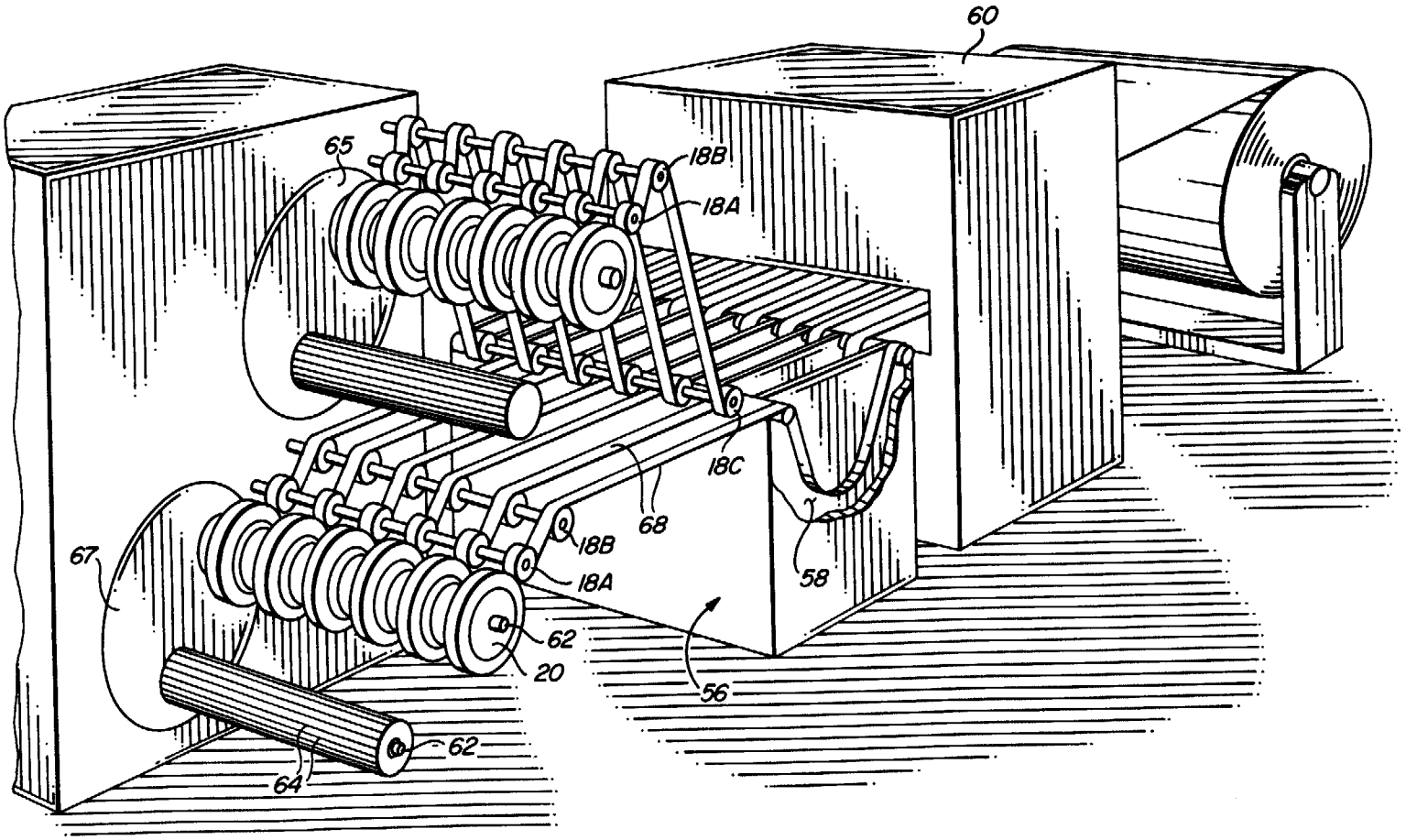
FIG. 7 is a perspective view of an alternate embodiment of the present invention.

In FIG. 7, another embodiment of the present invention is shown wherein a tension accommodating means 56 is placed between a slitting device 60 and shaft 62 with the plurality of supply reels 20. The tension accommodating means 56 includes a plurality of vacuum columns 58, one for each tape, see FIGS. 9 and 10. For this embodiment, the supply reels 20 are the same as shown in FIG. 5. No clutch members are needed. The shaft 62 includes a plurality of splines 64, see FIG. 8, with centering cutouts 66 spaced along its axial length of a design similar to the serrations 34 of the clutch members 22. The shafts 62 could be mounted onto turrets 68. The supply reels 20 are passed over the shaft 62 and positioned adjacent to the centering cutouts 66. The ends of each tape 68 are connected to the outer hub 46 of the supply reel 20. The shaft 62 is rotated to wind the tapes 68 and the vacuum columns 58 are actuated. The vacuum columns 58 in this embodiment act as the means for accommodating changes in tension as a result of the differences in diameter of the different supply reels 20 and the placement of the end of the tape onto the supply reel. The vacuum columns 58 must accommodate all the variations in the tape tension.

The principles of the present invention have now been made clear in an illustrative embodiment. There will be immediately obvious to those skilled in the art many modifications of the structure, arrangement, proportions, the elements, materials and components used in the practice of the invention. For instance, six supply reels are shown for accepting six tapes on each shaft in the embodiments of the invention. It should be obvious that any number of supply reels and shafts could be used to accept the plurality of webs from the slitter. Further, different shapes of centering devices could be used as the serrations according to the present invention. The serrations might be diamond-shaped entering cutouts in the serrations that are trough-shaped to accommodate the centering of the reel or the serrations and cutouts may be semi-circular in shape without departing from the present invention. Further, the preferred embodiment is used to wind magnetic tapes but it should be evident that any web of flexible material could be likewise wrapped onto the supply reel. The preferred mechanism for the clutch includes a separate clutch adaptor for ease of replacement purposes in the event the clutch fails. Other clutch designs and a single-piece clutch member could be adapted by those skilled in the art again without departing from the present invention. The appended claims are, therefore, intended to cover and embrace any such modification within the limits only of the tube spirit and scope of the invention.

What is claimed is:

1. Self-aligning apparatus driven by a rotatable shaft for winding a web of material comprising in combination:

spline means affixed to the rotatable shaft including at least one set of serrations spaced around the periphery of said spline means with a shaped cutout in at least one side of each of said serrations with each set spaced at the same axial distance along the shaft;

a reel including an outer circular hub for accommodating the web of material and an inner circular hub interconnected to said outer hub, said inner hub including elongated protrusions spaced around its inner diameter of a width to slide between two of the spaced serrations of said spline means, said protrusions shaped to seat into the associated shaped cutout of said serrations for aligning said reel with the shaft, the web of material and for rotatable driving said reel with said spline means and shaft; and tension means for adjusting the tension of the web of material as the web is wound on said reel.

2. A self-aligning apparatus as defined in claim 1 wherein said means for adjusting the tension of the web of material includes a hysteresis clutch fastened to said shaft and rotatable therewith to drive said spline means, said spline means affixed to the periphery of said clutch.

3. A self-aligning apparatus as defined in claim 2 including a plurality of said clutches spaced along the length of the shaft;

a plurality of said spline means, one adapted for each clutch, each of said spline means including one set of serrations spaced around its periphery; and a plurality of said reels, one driven by each spline means for winding a plurality of webs of material.

4. A self-aligning apparatus as defined in claim 1 wherein said inner diameter of said inner hub of said reel being of a size such that only the protrusions at and adjacent to the tangent position of the web of material relative to the outer hub seat into said shaped cutouts of said serrations.

5. A self-aligning apparatus as defined in claim 1 wherein said protrusions on the inner hub of said reel are elongated diamond-shaped and said shaped cutouts of said serrations are trough-shaped to approximately the same length as said protrusions.

6. Self-aligning apparatus as defined in claim 3 including a guide member fastened to a free end of the rotatable shaft, said guide member having a diameter approximately equal to the diameter of said spline means without said serrations, said guide member having a tapered section along an edge at the free end of the shaft drive for assisting in the centering of said reels as said reels are placed onto said plurality of spline means for alignment with its associated spline means.

7. Self-aligning apparatus for winding a plurality of webs of material to a rotatable drive comprising in combination:

a shaft rotated by the rotatable drive;

a plurality of cylindrical clutch members spaced along said shaft, each member having serrations spaced around the outer surface of its circumference, each of said serrations having spear points at each edge of the circumference width of the member and a shaped cutout in at least one side of each of said serrations; and a plurality of reels each including an outer hub for accommodating one web of material and an inner hub interconnected to the outer hub, said inner hub having an inner diameter slightly larger than the outer diameter of said member, said inner diameter including elongated protrusions spaced around the inner diameter of the inner hub of a width to slide between two of the spaced serrations of said member, said protrusions shaped to seat into said shaped cutouts of said serrations.

8. Self-aligning apparatus as defined in claim 7 wherein said protrusions on said inner hub of said reel are elongated diamond-shaped and said shaped cutouts of said serrations are trough-shaped to accommodate said elongated diamond-shaped protrusions.

9. Self-aligning apparatus as defined in claim 7 wherein said clutch member includes a hysteresis clutch attached to the rotatable shaft drive and an adaptor fastened to the outer circumference of said clutch, said adaptor having said serrations spaced around the outer surface of its circumference.

10. Self-aligning apparatus as defined in claim 7 including a guide member fastened to a free end of said shaft, said guide member having a diameter approximately equal to the diameter of said clutch member without said serrations, said guide member having a tapered section along an edge at the free end of the shaft drive for assisting in the centering of said reels as said reels are placed onto said clutch members for alignment with its associated clutch member.

11. Self-aligning apparatus according to claim 7 wherein said reels each include an interconnection between the inner hub and outer hub, said interconnection including relief offsets spaced apart with one end connected around the outer circumference of the inner hub and a second end connected to the inner circumference of the outer hub to accommodate the radial compression of the layers of the web material as the layers are reeled onto the outer hub.

12. A self-aligning apparatus as defined in claim 7 wherein said inner diameter of said inner hub of each of said reels being of a size such that only the protrusions at and adjacent to the tangent position of the web of material relative to the outer hub seat into said shaped cutouts of said serrations.

13. Self-aligning apparatus for connecting web-winding-reels to a rotatable drive comprising in combination:

a plurality of cylindrical clutch members spaced along the rotatable drive, each member having serrations spaced around the outer surface of its circumference, each of said serrations having spear points at each edge of the circumference width of the member and a trough-shaped cutout in at least one side of each of said serrations; and said reel including an outer hub for accommodating the web of material and an inner hub interconnected to the outer hub, said inner hub having an inner diameter slightly larger than the outer diameter of said member, said inner diameter including elongated diamond-shaped protrusions spaced around the inner diameter of the inner hub of a width to slide between two of the spaced serrations of said member, said protrusions shaped to seat into said trough-shaped cutouts of said serrations.

14. Winding apparatus for reeling a plurality of webs of material after slitting from a wider web, said winding apparatus comprising:

a rotatable drive shaft;

a plurality of clutch members mounted along the length of said shaft for rotation therewith, each of said clutch members having serrations spaced around the outer surface of its circumference, said serrations having spear points at each edge of the circumference width, and a cutout in at least one side of each of said serrations; and a plurality of reels, one for each of said plurality of clutch members, each reel including an outer hub for accommodating one of the plurality of webs of materials from the slitter and an inner hub interconnected to the outer hub, said inner hub having an inner diameter slightly larger than the outer diameter of said clutch member, said inner hub including protrusions spaced around its inner diameter and of a width to slide between two of the spaced serrations of said clutch member, said protrusions shaped to seat into said cutouts of said serrations.

15. Winding apparatus as defined in claim 14 wherein each of said clutch members includes a hysteresis clutch connected to the shaft for rotation and an adaptor attached to the outer circumference of each clutch, with each adaptor having said serrations spaced around the outer surface of its circumference.

16. Winding apparatus as defined in claim 14 wherein said protrusions are elongated diamond-shaped and said cutouts of said serrations are shaped to conform to said protrusions.

17. Winding apparatus according to claim 14 wherein said reel includes an interconnection between the inner hub and outer hub, said interconnection including relief offsets spaced apart with one end connected around the outer circumference of the inner hub and a second end connected to the inner circumference of the outer hub to accommodate the radial compression of the layers of the web material as the layers are reeled out to the outer hub.

18. A winding apparatus as defined in claim 14 wherein said inner diameter of said inner hub of each of said reels being of a size such that only the protrusions at and adjacent to the tangent position of the web of material relative to the outer hub seat into said shaped cutouts of said serrations.

19. Winding apparatus for reeling a plurality of webs of material after slitting from a wider web, said winding apparatus comprising:

a rotatable drive shaft;

a plurality of hysteresis clutches mounted along the length of said shaft for rotation therewith;

a plurality of cylindrical adaptors, one attached to the outer circumference of each of said clutches, each of said adaptors having serrations spaced around the outer surface of its circumference, said serrations having spear points at each edge of the circumference width, and a trough-shaped cutout centered in at least one side of each of said serrations; and a plurality of reels, one for each of said plurality of adaptors, each reel including an outer hub for accommodating one of the plurality of webs of materials from the slitter and an inner hub interconnected to the outer hub, said inner hub having an inner diameter slightly larger than the outer diameter of said adaptor, said inner hub including diamond-shaped protrusions spaced around its inner diameter of a width to slide between two of the spaced serrations of said adaptor, and a length approximately equal to the width of said inner hub said protrusions shaped to seat into said cutouts of said serrations.

20. Winding apparatus as defined in claim 19 including a guide member fastened to a free end of the rotatable drive shaft, said guide member having a diameter approximately equal to the diameter of said adaptor without said serrations, said guide member having a tapered section along an edge at the free end of said shaft for assisting in the centering of said reels as said reels are placed onto said adaptors for alignment with its associated clutch and adaptor.

21. Winding apparatus according to claim 19 wherein each of said reels includes an interconnection between the inner hub and outer hub, said interconnection including relief offsets spaced apart with one end connected around the outer circumference of the inner hub and a second end connected to the inner circumference of the outer hub to accommodate the radial compression of the layers of the web material as the layers are reeled out to the outer hub.

22. A winding apparatus as defined in claim 19 wherein said inner diameter of said inner hub of said reel being of a size such that only the protrusions at and adjacent to the tangent position of the web of material relative to the outer hub seat into said shaped cutouts of said serrations.

* * * * *